US012723767B2

(12) United States Patent
Lyu et al.

(10) Patent No.: US 12,723,767 B2
(45) Date of Patent: Sep. 1, 2026

(54) REFRIGERATING APPLIANCE FOR HIGH-SPEED VAPORIZATION OF A WATER WORKING MEDIUM AND A DESIGN AND MANUFACTURING METHOD THEREOF

(71) Applicant: Jianhua Lyu, Suzhou (CN)

(72) Inventors: Jianhua Lyu, Suzhou (CN); Yu Yan, Suzhou (CN); Xinghua Lyu, Suzhou (CN); Yunping Yan, Suzhou (CN)

( * ) Notice: Subject to any disclaimer, the term of this patent is extended or adjusted under 35 U.S.C. 154(b) by 119 days.

(21) Appl. No.: 18/834,525

(22) PCT Filed: Jan. 10, 2023

(86) PCT No.: PCT/CN2023/000032
§ 371 (c)(1),
(2) Date: Jul. 30, 2024

(87) PCT Pub. No.: WO2024/148444
PCT Pub. Date: Jul. 18, 2024

(65) Prior Publication Data
US 2025/0137667 A1 May 1, 2025

(51) Int. Cl.
*F24F 5/00* (2006.01)

(52) U.S. Cl.
CPC ..... *F24F 5/0035* (2013.01)

(58) Field of Classification Search
CPC ..... F24F 5/0035; F24F 5/00
See application file for complete search history.

(56) References Cited

U.S. PATENT DOCUMENTS

2010/0251692 A1 10/2010 Kinde, Sr.
2011/0309160 A1* 12/2011 Kazem ..... F24F 6/16 239/231

FOREIGN PATENT DOCUMENTS

| | | | |
|---|---|---|---|
| CN | 2697073 | Y | 5/2005 |
| CN | 101672503 | A | 3/2010 |
| CN | 115111686 | A | 9/2022 |
| GB | 751609 | A | 7/1956 |
| GB | 1008358 | A | 10/1965 |
| JP | 2022174693 | A * | 11/2022 |

OTHER PUBLICATIONS

Acosta (Acosta, W., Experimental Study of the Spray Characteristics of a Research Airblast Atomizer, Mar. 1984, [retrieved on Jan. 7, 2026], Retrieved from Internet < https://ntrs.nasa.gov/citations/19850007418 >.) (Year: 1984).*

(Continued)

*Primary Examiner* — Elizabeth J Martin
*Assistant Examiner* — Keona Lauren Banks

(57) ABSTRACT

A method of a refrigerating appliance for speed vaporization of a water working medium, the technical feature adopted is to use a number of splash wings rotating in opposite directions at speed to form two groups of splash surfaces, so as to continuously and repeatedly splash an amount of water flow, and forcibly convert the water working medium into ultra-fine droplets with the total surface area through the micro-vortex cyclones generated by the reversal of the splash wings, and then use an ultrasonic sound field reduce the water vapor saturation that destroys the liquid-gas interface.

1 Claim, 6 Drawing Sheets

(56) References Cited

OTHER PUBLICATIONS

Martínez, P., et al., Experimental study of an ultrasonic mist generator as an evaporative cooler, Nov. 2020, Applied Thermal Engineering, vol. 181, [retrieved on Jan. 7, 2026]. Retrieved from Internet <DOI: https://doi.org/10.1016/j.applthermaleng.2020.116057:> (Year: 2020).*
Ito (JP2022174693A) English Translation (Year: 2022).*

* cited by examiner

REFRIGERATING APPLIANCE FOR HIGH-SPEED VAPORIZATION OF A WATER WORKING MEDIUM AND A DESIGN AND MANUFACTURING METHOD THEREOF

TECHNICAL FIELD

The invention belongs to the category of refrigerating appliances with high-speed vaporized water flow.

BACKGROUND ART

Traditional electric "air conditioning" refrigerators absorb heat by boiling and vaporizing certain types of working medium. In addition to polluting the environment, they consume a lot of energy because they need to circulate and recycle the vaporized working medium. And they still only discharge the indoor heat to the outside, and the heat generated by the power consumption during phase change conversion must be added. The release of a large amount of heat energy can only seriously increase the temperature of the ground environment and the atmospheric temperature.

Therefore, the best way to cool down is to take the heat near the ground to high altitude and then release it. Consider using water, a substance with the largest heat of vaporization, as the working medium to vaporize and absorb heat for cooling. According to the specifications of the largest central air conditioner currently available on the market, 220 kW of cooling capacity requires 50 kW of electricity. This cooling capacity is roughly equivalent to the heat absorbed by 100 cc of vaporized water per second. In other words, in order to achieve such a cooling purpose, only 100 cc of water needs to be vaporized per second to obtain the cooling capacity of a central air conditioner with a cooling capacity of 220 kW. Compared with the power consumption of electric air conditioners, this can not only save a lot of electricity, but also achieve excellent results in environmental protection because the discharge is only ordinary water that does not need to be recycled.

As for the current technical means, if water, a substance with the largest heat of vaporization, is used as the working medium for heat absorption and refrigerating at room temperature, although it is not necessary to recover water vapor, this method of utilizing the vaporization of water as the working medium cannot vaporize or boil in the liquid state, but can only vaporize and absorb heat in the form of surface evaporation. For refrigerating appliances designed for heat absorption as the main purpose, the effect of this heat absorption method with too slow vaporization speed is far from meeting the practical requirements. According to the current technical level, it is still difficult to achieve such a sufficient cooling effect.

SUMMARY OF THE INVENTION

Technical Problems to be Solved by the Invention

In the invention of "Water Atomization Evaporation Cooling Device and System" with patent number ZL200810148953.7, compared with the common electric air conditioner method of achieving internal simultaneous vaporization and rapid heat absorption by boiling liquid working medium, a technical solution of ultra-fine atomization of water at room temperature far below the boiling point of water working medium is proposed, so as to greatly increase the total surface area of liquid water to increase its evaporation and vaporization speed, and achieve a rapid heat absorption cooling effect. The purpose of the invention is to further improve this device on this basis, using a large number of splash wings rotating in opposite directions at high speed to form two groups of large-area splash surfaces, so as to continuously and repeatedly splash a sufficient amount of room-temperature water flow, and convert the countless micro-vortex cyclones generated by the splash wings into ultra-fine droplets with the largest total surface area, and then use an ultrasonic sound field to greatly reduce the water vapor saturation of the liquid-gas interface, further promoting the rapid and complete vaporization of the droplets to absorb heat. In order to allow sufficient water to be vaporized at a high speed by ultra-fine atomization, the technical solution adopted by the invention to solve the technical problem has the following technical features: two sets of large-area splash wings rotating in opposite directions are used to fully splash a sufficient amount of water flow, and the water working medium is finely atomized through the repeated sputtering process, while the air in the fine atomization space is rolled inward to stir up countless micro-vortex cyclones to further tear these fine mist droplets into smaller pieces, so that these ultra-fine mist droplets have the largest total surface area to increase their evaporation rate. And the water vapor saturation gradient existing at the gas-liquid interface of the micro-water droplets, which has a particularly serious hindering effect on the vaporization phase change rate, is disturbed and destroyed by sound waves to greatly reduce the water vapor saturation of the interface, so that the water vapor vaporized on the liquid surface can be accelerated and diffused away and the liquid vaporization evaporation rate at the liquid-gas interface can be greatly increased, thereby achieving the effect of further accelerating the vaporization rate of the water mist.

The technical feature is to provide a vaporization chamber, in which two groups of cylindrical splash wing grids each having a plurality of coaxial centers are interlaced and rotate at high speed in opposite directions; these cylindrical splash wing grids are composed of splash wings with a certain curved surface shape as grid columns; the two groups of cylindrical splash wing grids are respectively fixed on corresponding upper and lower trays to splash the injected water flow. The two trays are respectively pulled by two driving shafts which are coaxially sleeved together and rotate in opposite directions, to drive the two sets of embedded cylindrical splash wing grids to rotate in opposite directions, so as to continuously and repeatedly splash the injected water into ultra-fine droplets. In addition, the two sets of high-speed counter-rotating cylindrical splash wing grids also stir the air in the vaporization chamber space into countless micro-vortices. One bottom end of the cylindrical splash wing grid is fixed on a tray connected to the driving shaft, and other suspended edge end is clamped on the bottom end of another set of corresponding cylindrical splash wing grids, that is, the track groove of the opposite tray, through a ceramic bearing or pulley, so that the two sets of splash wing grids can be supported and rotated stably. Splashing spokes are fixed on the outermost driving shaft, and the center of the upper tray is provided with a vaporization chamber cover; the driving shaft passes through the large circular hole in the center and is fastened to the center of several compressed air blades arranged below the circular hole of the vaporization chamber cover; the compressed air blades connected to the upper tray drive the upper tray and the cylindrical splashing wing grid on the upper tray to rotate at high speed, while the lower tray is fixed on the reverse driving shaft, and the driven shaft rotates in the reverse direction and drives the cylindrical splashing wing grid on the lower tray to rotate at high speed. At the same time, water is introduced by a sprinkler head, so that a sufficient amount of water can enter the space between the two trays and splash onto the cylindrical splash wing grid. The splash wings of the cylindrical splash wing grid rotating in opposite directions are splashed back and forth layer by layer, and are gradually atomized into ultra-fine atomization.

In order to increase the vaporization speed of water, an ultrasonic sound field is provided in the outer space of the vaporization chamber, the air outlet and the air duct. The strong reactive power is used to generate a sound field in the outer space to obtain the resonance of the sound wave, so that the saturation gradient of the water vapor at the gas-liquid interface of these output micro-water droplets is greatly disturbed and changed. The water vapor saturation sensor at the outlet of the air duct limits the maximum amount of water entering the water regulator.

SPECIFIC EMBODIMENT OF THE INVENTION

Figure 1:
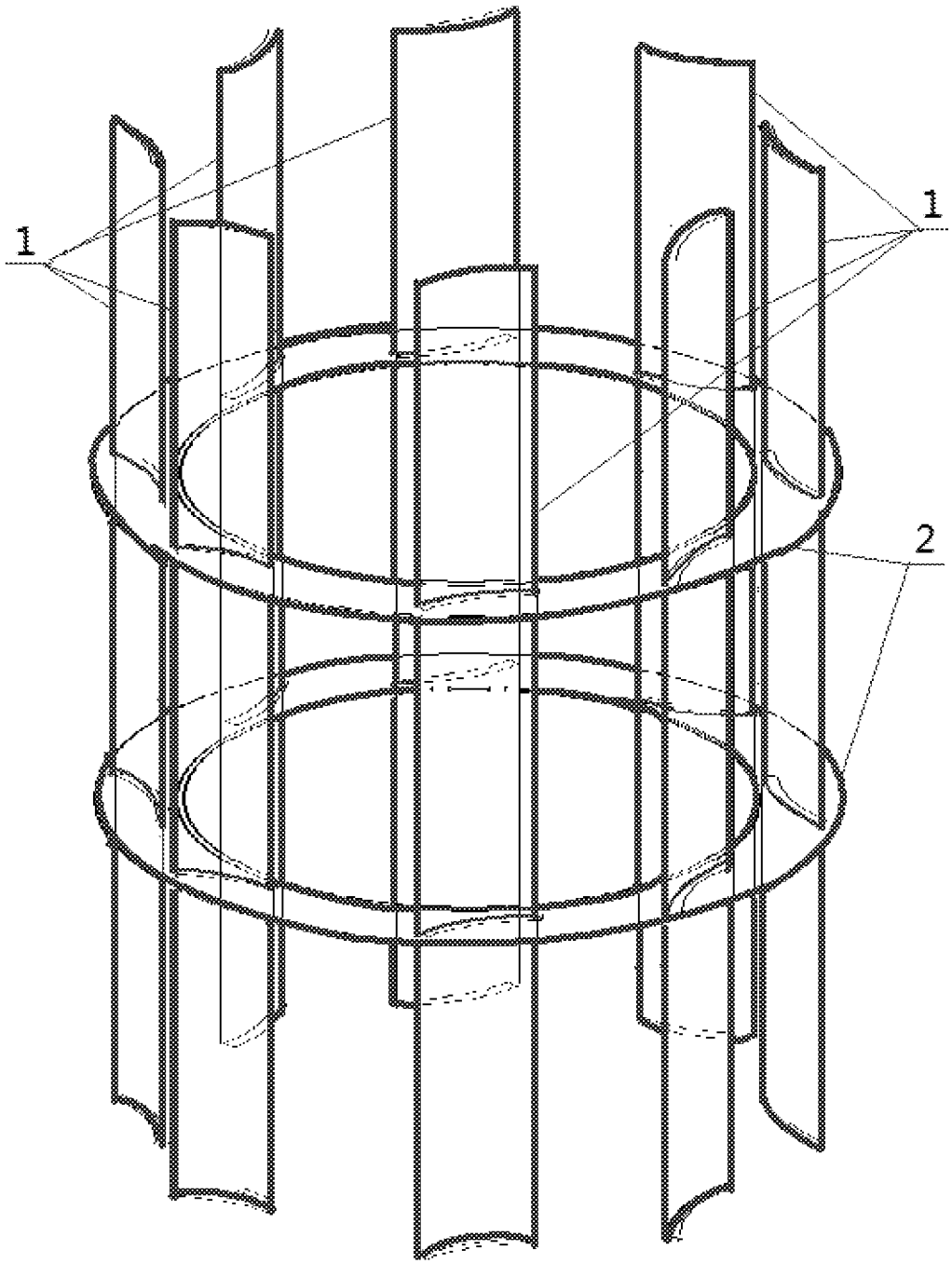
FIG. 1 is a schematic diagram of the structure of the cylindrical splash wing grid. 1 refers to the splash wing of the cylindrical splash wing grid; 2 refers to the waist hoop of the cylindrical splash wing grid.
Figure 2:
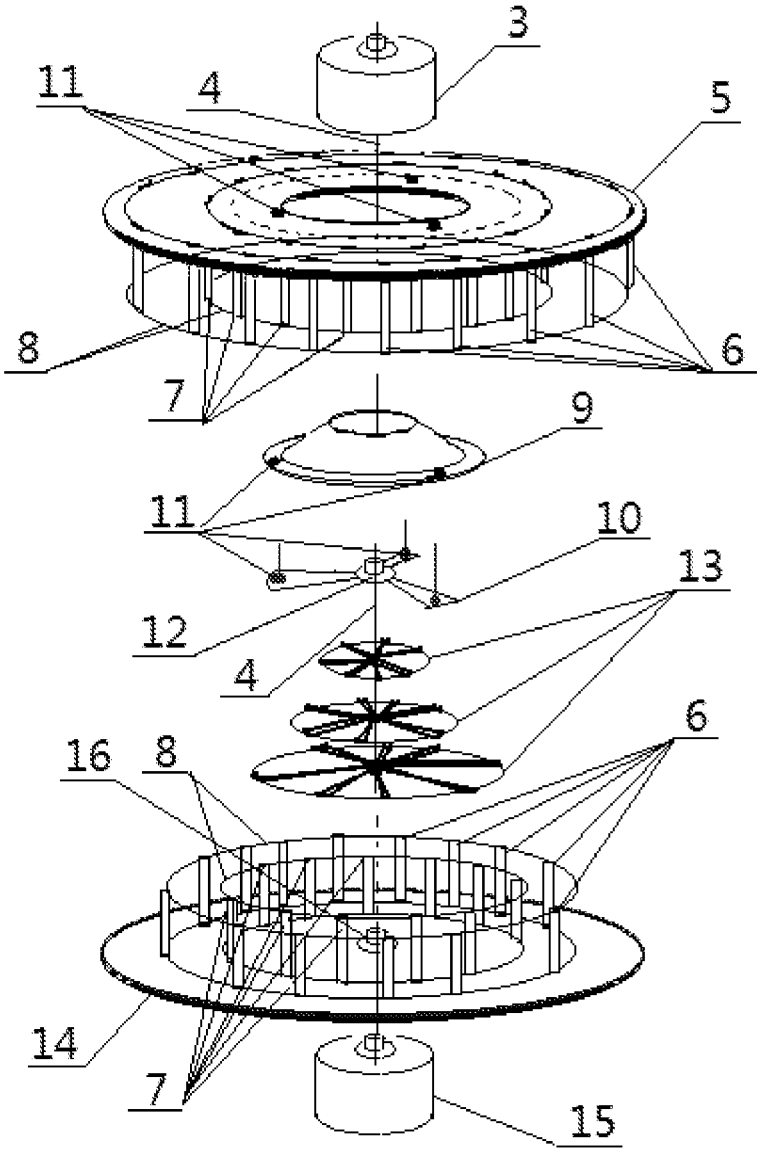
FIG. 2 is a schematic diagram of the disassembled parts of the vaporization chamber. 3 refers to the driving motor of the upper tray; 4 refers to the driving shaft of the upper tray motor; 5 refers to the upper tray; 6 refers to the cylindrical splash wing grid on the outside; 7 refers to the cylindrical splash wing grid on the inside; 8 refers to the suspended edge of the cylindrical splash wing grid; 9 refers to the vaporization chamber cover in the center of the upper tray; 10 refers to the compressor fan blade; 11 refers to the screw hole for fixing the vaporization chamber cover and the compressor fan blade on the tray; 12 refers to the shaft sleeve for fixing the compressor fan blade on the motor shaft; 13 refers to the splash plate spoke fixed on the driving shaft; 14 refers to the lower tray; 15 refers to the driving motor of the lower tray; 16 refers to the shaft sleeve for fixing the lower tray on the lower driving shaft.
Figure 3:
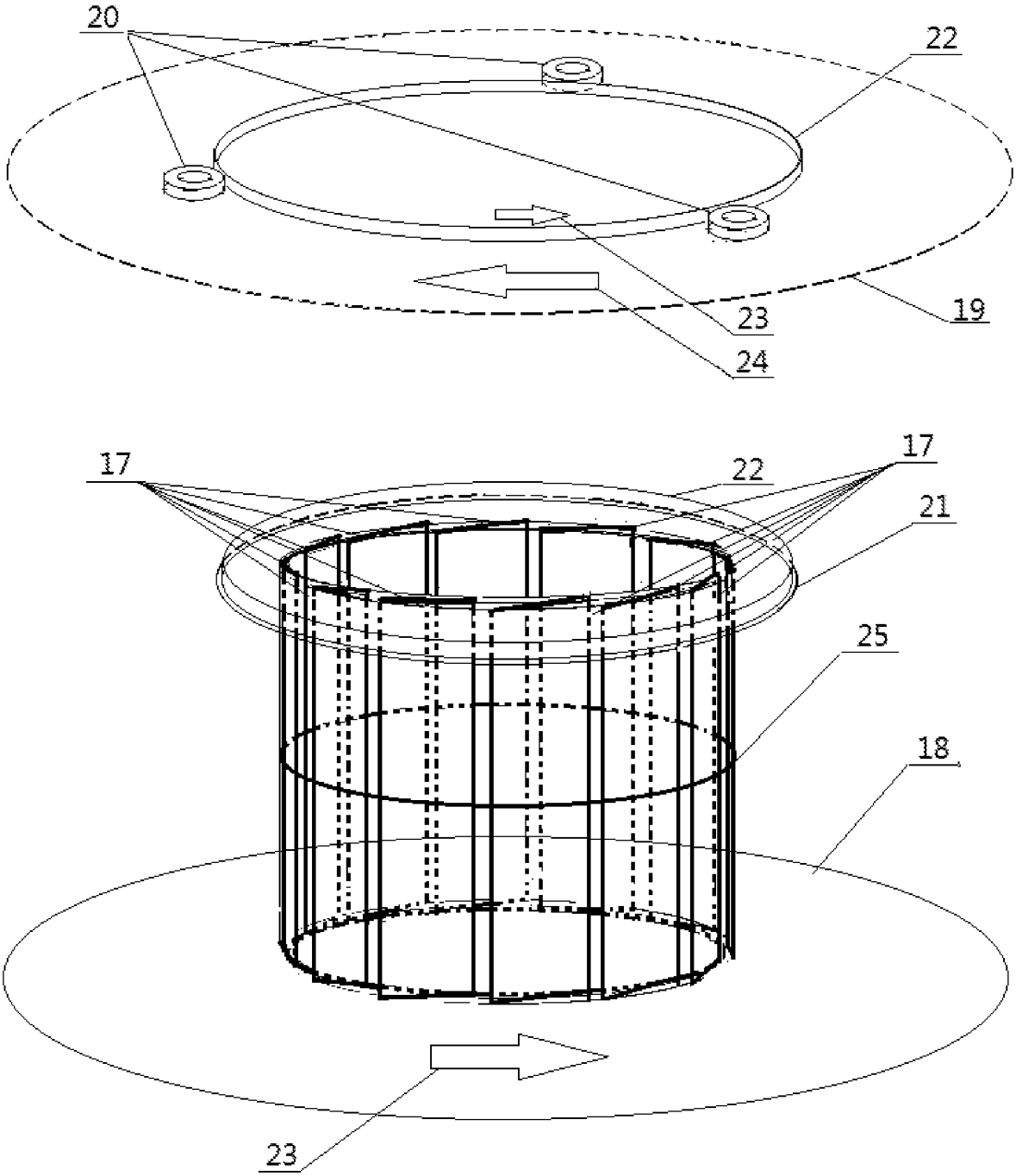
FIG. 3 is a schematic diagram of stabilizing the suspended edge of a single cylindrical splash wing grid. 17 refers to the cylindrical splash wing grid composed of splash wings; 18 refers to the tray for fixing the cylindrical splash wing grid; 19 refers to the tray opposite to the cylindrical splash wing grid; 20 refers to the ball bearing composed of ceramic or tempered glass beads fixed on the tray opposite to the cylindrical splash wing grid with the inner center; 21 refers to the folded edge of the suspended edge of the cylindrical splash wing grid; 22 refers to the track groove on the folded edge of the suspended edge of the cylindrical splash wing grid for the ball bearing to roll and run, and the direction thereof is indicated by the arrow shown in 23; arrow 24 indicates the direction of the tray opposite to the cylindrical splash wing grid; 25 refers to the waist hoop of the cylindrical splash wing grid.
Figure 4:
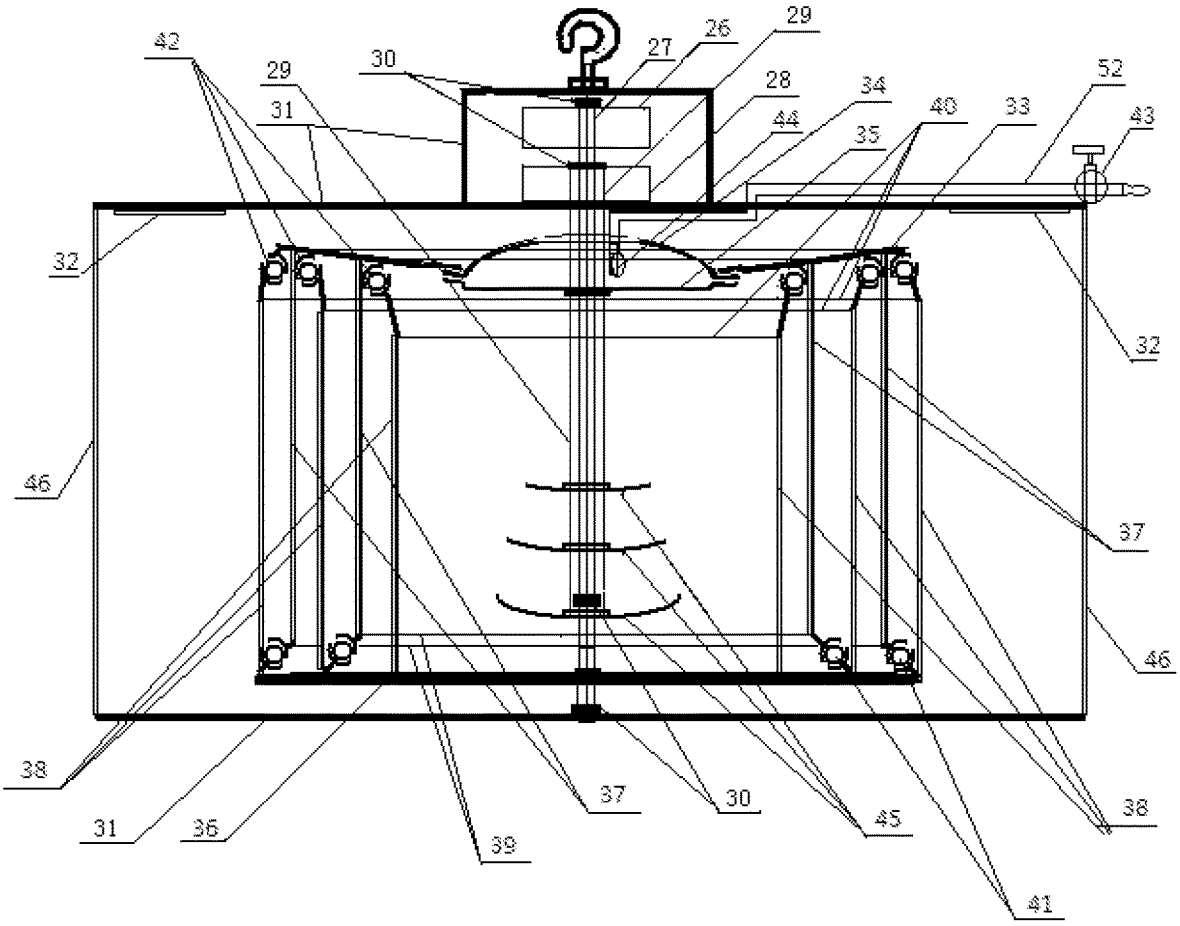
FIG. 4 is a schematic longitudinal section of the vaporization chamber structure driven by the sleeve shaft and dual motors. 26 refers to the driving motor; 27 refers to the driving shaft of the driving motor; 28 refers to another driving motor rotating in the opposite direction; 29 refers to the driving shaft of the driving motor rotating in the opposite direction; 30 refers to the bearing; 31 refers to the housing; 32 refers to the piezoelectric ceramic sheet; 33 refers to the upper tray; 34 refers to the vaporization chamber cover with a circular hole; 35 refers to the compressor fan blade connected to the upper tray fixed on the reverse driving shaft; 36 refers to the lower tray; 37 refers to the group of concentric cylindrical splash wing grids fixed on the upper tray; 38 refers to the group of concentric cylindrical splash wing grids fixed on the lower tray; 39 refers to the suspended edge of a group of concentric cylindrical splash wing grids fixed on the upper tray; 40 refers to the suspended edge of a group of concentric cylindrical splash wing grids fixed on the lower tray; 41 refers to the ceramic ball bearing support for stabilizing the suspended edges of a group of concentric cylindrical splash wing grids fixed on the upper tray to the track groove of the lower tray; 42 refers to the ceramic ball bearing support for stabilizing the suspended edges of a group of concentric cylindrical splash wing grids fixed on the lower tray to the track groove of the upper tray; 43 refers to the water volume regulator; 44 refers to the nozzle for introducing water flow into the vaporization chamber; 45 refers to the spoke-shaped splash plate; 52 refers to the water inlet conduit; 46 refers to the air outlet.
Figure 5:
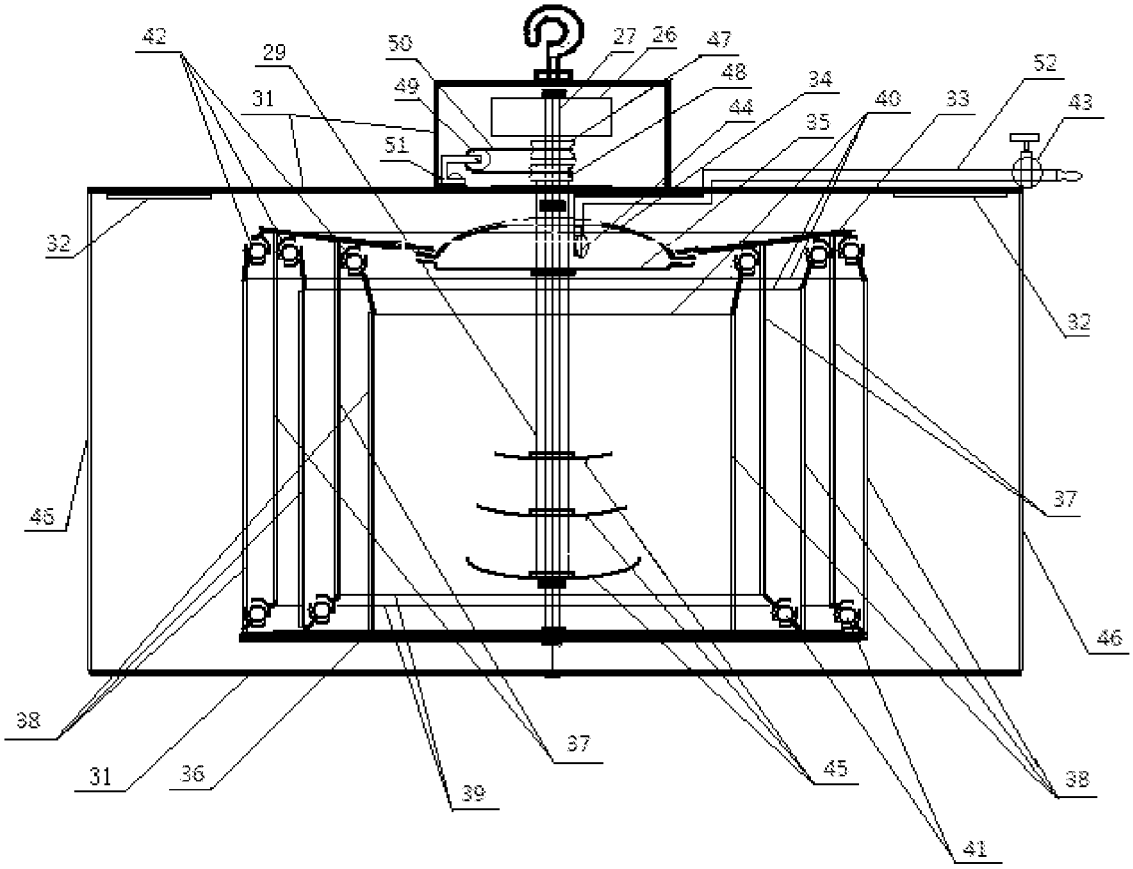
FIG. 5 is a schematic longitudinal section of a vaporization chamber structure driven by a portable single motor and turned by a belt drive. 26 refers to the driving motor; 27 refers to the driving shaft of the driving motor; 31 refers to the housing; 32 refers to the piezoelectric ceramic sheet; 33 refers to the upper tray; 34 refers to the vaporization chamber cover with a circular hole; 35 refers to the compressed air fan blade connected to the reverse driving shaft to fix the upper tray; 36 refers to the lower tray; 37 refers to the group of concentric cylindrical splash wing grids fixed on the upper tray; 38 refers to the group of concentric cylindrical splash wing grids fixed on the lower tray; 39 refers to the suspended edge of a group of concentric cylindrical splash wing grids fixed on the upper tray; 40 refers to the suspended edge of a group of concentric cylindrical splash wing grids fixed on the lower tray; 41 refers to the ceramic ball bearing support that stabilizes the suspended edge of a group of concentric cylindrical splash wing grids fixed on the upper tray to operate in the track groove of the lower tray; 42 refers to the ceramic ball bearing support for stabilizing the suspended edge of a group of concentric cylindrical splash wing grids fixed on the lower tray to run in the track groove of the upper tray; 43 refers to the water regulator; 44 refers to the nozzle for introducing water flow into the vaporization chamber; 45 refers to the spoke-shaped splash plate; 52 refers to the water inlet duct; 46 refers to the air outlet; 49 refers to the two steering pulleys; 50 refers to the steering belt; 51 refers to the steering pulley bracket; 47 refers to the belt pulley fixed on the driving shaft of the driving motor; 48 refers to the belt pulley fixed on the reverse driving shaft.
Figure 6:
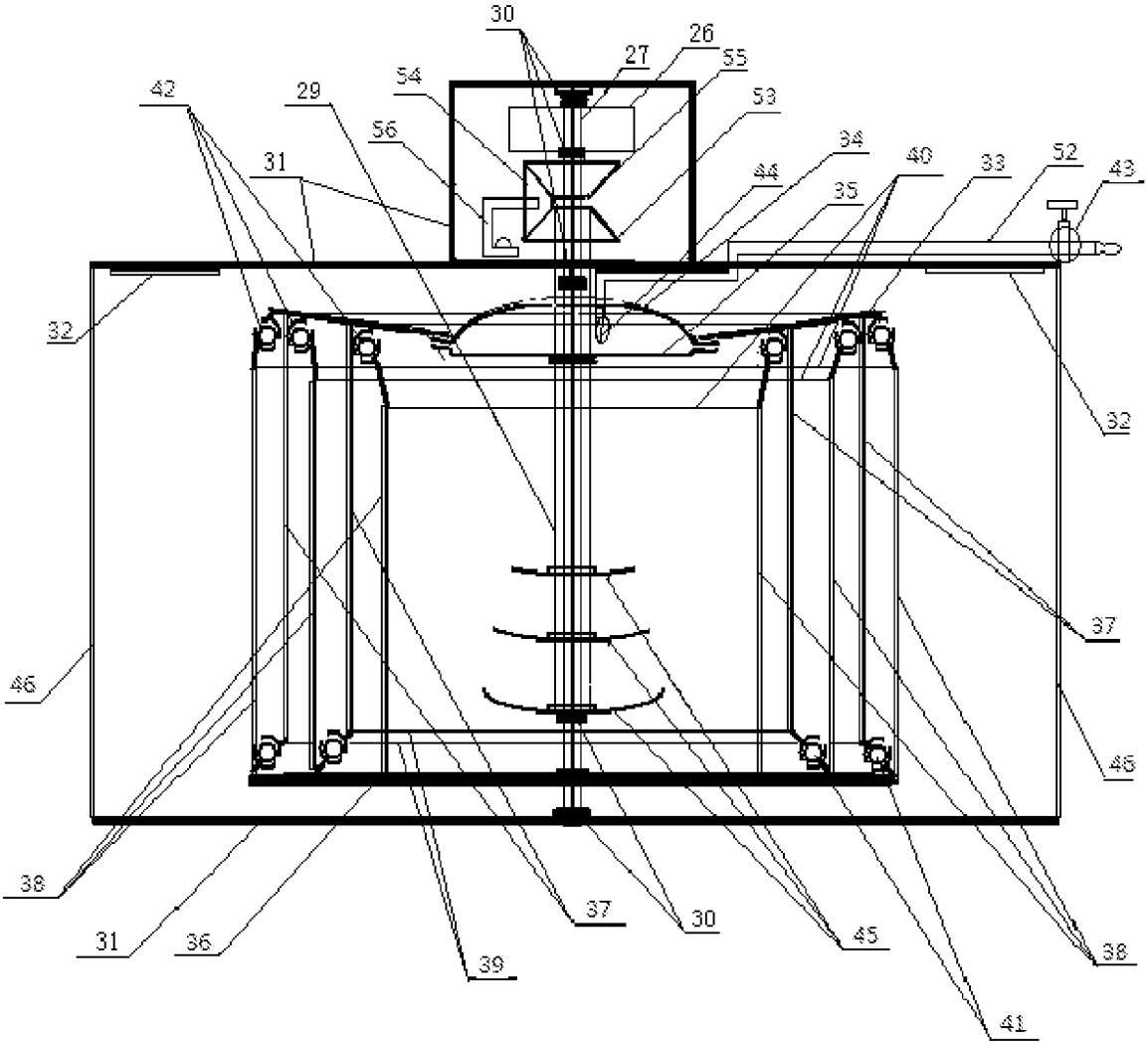
FIG. 6 is a schematic longitudinal section of a vaporization chamber structure driven by a single motor and turned by a high-power bevel gear. 26 refers to the driving motor; 27 refers to the driving shaft of the driving motor; 30 refers to the bearing; 31 refers to the housing; 32 refers to the piezoelectric ceramic sheet; 33 refers to the upper tray; 34 refers to the vaporization chamber cover with a circular hole; 35 refers to the compressed air fan blade connected to the reverse driving shaft to fix the upper tray; 36 refers to the lower tray; 37 refers to the group of concentric cylindrical splash wing grids fixed on the upper tray; 38 refers to the group of concentric cylindrical splash wing grids fixed on the lower tray; 39 refers to the suspended edge of a group of concentric cylindrical splash wing grids fixed on the upper tray; 40 refers to the suspended edge of a group of concentric cylindrical splash wing grids fixed on the lower tray; 41 refers to the ceramic ball bearing support that stabilizes the suspended edge of a group of concentric cylindrical splash wing grids fixed on the upper tray to operate in the track groove of the lower tray; 42 refers to the ceramic ball bearing support for stabilizing the suspended edge of a group of concentric cylindrical splash wing grids fixed on the lower tray to run in the track groove of the upper tray; 43 refers to the water regulator; 44 refers to the nozzle for introducing water flow into the vaporization chamber; 45 refers to the spoke-shaped splash plate; 52 refers to the water inlet duct; 46 refers to the air outlet; 53 refers to the bevel gear sleeved on the reverse drive shaft; 54 refers to the intermediate bevel gear; 55 refers to the bevel gear sleeved on the drive shaft of the drive motor; 56 refers to the bevel gear bracket.

The invention will be further described hereinafter with reference to the drawings and embodiments.

In order to enable those skilled in the art to better understand the invention, and thus to more clearly define the scope of the invention and implement it accordingly, the invention will be described in detail with respect to some specific embodiments of the invention. It should be noted that the following are only some specific implementation methods of the invention, which are only some embodiments of the invention, wherein the specific and direct description of the technical concept and characteristics of the relevant structure is only for the convenience of understanding the content of the invention and implementing it accordingly, and each specific feature does not naturally and directly limit the scope of implementation of the invention. The modifications, conventional selections and substitutions made by those skilled in the art under the guidance of the spiritual essence of the main technical scheme of the invention should all be covered within the scope of the invention.

In the vaporization chamber driven by dual motors, a powerful driving motor 26 drives the driving shaft 27 of the driving motor to drive the lower tray 36 and a group of concentric cylindrical splashing wing grids 38 fixed on the lower tray 36 to rotate at high speed. The driving shaft 29 of another powerful driving motor 28 rotating in the opposite direction at high speed drives the upper tray 33 and another group of concentric cylindrical splashing wing grids 37 fixed on the upper tray 33 to rotate at high speed in the opposite direction to the upper group of concentric cylindrical splashing wing grids 38, thereby forming a large number of micro-vortex cyclones that further ultra-finely atomize the water droplets. The water volume regulator 43 defined by the water vapor saturation sensor controls the water inlet conduit 52 to introduce the water flow into the nozzle 44 of the vaporization chamber and sprinkle it into the vaporization chamber, and then the water is thrown by the spoke-shaped splashing plate 45 onto the large-area splashing wings of the high-speed rotating cylindrical splashing wing grid frame to be splashed into fine mist, and is repeatedly splashed by the large-area splashing wings of the two groups of cylindrical splashing wing grid frames along with the air flow and torn into ultra-fine water mist by countless micro-vortex cyclones in the vaporization chamber. When passing through the air duct, the water vapor saturation gradient of the liquid-gas interface of the mist droplets is destroyed under the strong acoustic oscillation driven by the piezoelectric ceramic plate 32, which accelerates the vaporization rate of liquid water.

The beneficial effects of the invention are as follows.

Compared with electric air conditioners, this type of refrigerating appliance that uses water as the working medium is simpler and more reliable in structure, very lightweight, and has very low resource requirements. It can be widely used in transportation facilities, vehicles, ships, subways, underwater aircraft, and aerospace. It is particularly suitable for outdoor operations and as a portable labor protection equipment in jobs such as traffic police on duty.

In addition to the obvious environmental protection and energy-saving effects, if seawater is used as the water source for large-scale vaporization, the trouble of consuming fresh water sources can be saved. In addition to the sideline production of industrial salt products, large-scale vaporization can also cool the region and even the earth.

With a cold source and water vapor that has been evaporated and filtered to remove most of the salt, based on simple machinery and cheap energy consumption, further research and development will make large-scale seawater desalination no longer an unattainable fairy tale for coastal desert areas where water is more expensive than oil.

Companies that need to treat severe sewage discharge can use this appliance to concentrate polluted water and recycle waste to reduce sewage discharge.

For poor areas, the invention enables the general public to obtain affordable and cheap cooling appliances.

What is claimed is:

1. A method of a refrigerating appliance for vaporization of a water working medium, the technical feature adopted is to use a number of splash wings rotating in opposite directions to form two groups of splash surfaces, so as to continuously and repeatedly splash an amount of water flow, and forcibly convert the water working medium into droplets with the total surface area through micro-vortex cyclones generated by the reversal of the splash wings, and then use an ultrasonic sound field to reduce the water vapor saturation and destroy the liquid-gas interface;

wherein the technical feature thereof is to provide a vaporization chamber, in which two groups of cylindrical splash wing grids each having a plurality of coaxial centers are interlaced and rotate in opposite directions; these cylindrical splash wing grids are composed of splash wings with a curved surface shaped as grid columns; the two groups of cylindrical splash wing grids are fixed on a corresponding top tray and a corresponding bottom tray; the two trays rotate in opposite directions to drive the two groups of cylindrical splash wing grids to rotate in opposite directions; one bottom end of the cylindrical splash wing grid is fixed on a tray connected to a driving shaft, and the other suspended edge end is supported by a ceramic bearing or a pulley stuck on the track groove of another set of corresponding cylindrical splash wing grid bottom ends, that is, on the opposite tray for stable rotation; splashing spokes are fixed on an outermost driving shaft, and a center of the top tray is provided with a vaporization chamber cover; a driving shaft passes through a large circular hole in the center and is fastened to the center of several compressed fan blades arranged below the circular hole of the vaporization chamber cover; the compressed fan blades connected to the top tray drive the top tray and the cylindrical splash wing grid on the top tray to rotate, while the bottom tray is fixed on a reverse driving shaft, a driven shaft that rotates in a reverse direction and drives the cylindrical splash wing grid on the bottom tray to rotate; a water pipe connected to a water spray head passes through the circular hole in the center of the vaporization chamber cover, and the water pipe is connected to a water volume regulator defined by a water vapor saturation sensor at an outlet of an air duct to connect to a water supply source; and piezoelectric ceramics driven by a switching power supply that generate ultrasonic waves are provided in an extended space of a vaporization chamber, the air outlet, and the air duct.

* * * * *